US005189958A

United States Patent [19]

Tafel et al.

[11] Patent Number: 5,189,958

[45] Date of Patent: Mar. 2, 1993

[54] PLATE CLAMPING SYSTEM FOR A DUPLICATING MACHINE

[75] Inventors: Leonard I. Tafel, Mount Prospect; Joseph S. Nowik, Skokie; Siegfried H. Lebherz, Chicago, all of Ill.

[73] Assignee: A. B. Dick Company, Chicago, Ill.

[21] Appl. No.: 681,045

[22] Filed: Apr. 5, 1991

[51] Int. Cl.[5] ..... B41F 1/28

[52] U.S. Cl. ..... 101/415.1; 101/DIG. 36

[58] Field of Search ..... 101/415.1, 378, DIG. 36, 101/116, 127.1, 128.1

[56] References Cited

U.S. PATENT DOCUMENTS

| | | | |
|---|---|---|---|
| 2,737,887 | 3/1956 | Gericke | 101/415.1 |
| 3,110,255 | 11/1963 | Jeschke et al. | 101/415.1 |
| 3,311,052 | 3/1967 | Zeuthen | 101/415.1 |
| 3,583,318 | 6/1971 | Stevenson | 101/415.1 |
| 3,835,778 | 9/1974 | Bock | 101/415.1 |
| 4,596,186 | 6/1986 | Shimizu | 101/248 |
| 4,785,736 | 11/1988 | Jeschke | 101/415.1 |
| 4,862,800 | 9/1989 | Wieland et al. | 101/415.1 |
| 4,938,135 | 7/1990 | Wieland | 101/415.1 |
| 5,088,409 | 2/1992 | Roskosch | 101/415.1 |

FOREIGN PATENT DOCUMENTS

| | | | |
|---|---|---|---|
| 224139 | 4/1962 | Austria | 101/415.1 |

*Primary Examiner*—Edgar S. Burr
*Assistant Examiner*—Ren Yan
*Attorney, Agent, or Firm*—Jones, Day, Reavis & Pogue

[57] ABSTRACT

An improved plate clamping assembly for a duplicating machine which utilizes a pivoted or cantilevered beam in the leading edge plate clamp assembly and a calibrated cocking screw to enabling skewing of the plate on the plate cylinder by moving one end of the pivoted or cantilevered beam. The improved assembly also coordinates the leading and trailing edge assemblies during installation of the plate by automatically adjusting the trailing edge plate clamp assembly to accommodate for an adjustment in skewing of the leading edge of the plate by the leading edge clamp assembly. Finally, it utilizes spring assemblies to enable self-adjustment for different plate thicknesses.

21 Claims, 4 Drawing Sheets

PLATE CLAMPING SYSTEM FOR A DUPLICATING MACHINE

FIELD OF THE INVENTION

The present invention relates in general duplicating machine such as a printing press and in particular to an improved plate clamping system for adjusting the plate or master with respect to the plate cylinder.

BACKGROUND OF THE INVENTION

There are different duplicating processes which depend on positioning an image on a printing substrate such as a copy sheet in accurate alignment with a predetermined reference on a plate or master cylinder and adjusting the image position relative to the reference, if necessary, in order to achieve requisite printing quality on the substrate. One such duplicating process is the offset duplicating process. Commonly, a master carrying assembly, for example, a cylinder, serves to hold the master or plate during the cyclical operation that effects the transfer of images to the copy paper. The head end of the master is held securely by the master carrying assembly. The holding mechanism may take various forms including one form which clamps a master end. Another form of the master holding or securing mechanism may have a series of pins projecting from a bar extending generally parallel to the cylinder axis and mounted adjacent the cylinder periphery. The master end holding means, whatever its form may be, is preferably adjustable, both angularly and perpendicularly, relative to the direction of movement of the master carrying assembly to suitably align the print on the copy sheet. This is because the orientation of the image on the master, for example the lines of print across the width of the master, are not necessarily precisely related to the master end or to the perforations in the master, which are the portions of the master engaged by the master holding means. To explain further, a clamp commonly has a straight edge against which one end of the master is pressed before the master is gripped to align the master relative to the carrying assembly. If the end of the master is not parallel to the lines of print, then the duplicated image will be skewed on the copy sheet. In the other holding means referred to, a pin bar is provided to engage the perforations. It is understandable how an image may be misaligned on a copy sheet if the perforations or pin holes along the edge of a master are not aligned properly relative to the image on the master.

Prior art devices have structures which adjust the alignment of the pin bars. One example of such structure is a thumb screw positioned to one side of a center pivot for the beam which connects the pin bar to the frame of the master carrying assembly. The thumb screw has posts on either side extending in opposite directions which have left-hand and right-hand threads, respectively. One post is threaded in a fixed support and the other is threaded in a support which is a part of the pivotable beam. Turning of the screw draws one side of the beam toward the fixed support or forces that side of the beam away from the fixed support, depending on which direction the thumb screw is turned, thereby pivoting the beam and the pin bar with it. It is in this way that the master is aligned. Such a structure is adapted for installation on the A. B. Dick Company (assignee of the present invention) Model 360 offset press.

Commonly assigned U.S. Pat. No. 4,459,913 provided needed corrections to the prior art and discloses a master carrier having a surface overlayed by a master sheet and which carrier has an assembly for clamping the straightedge of the master, such clamping assembly being provided with an improved mechanism for adjusting the position of the master sheet relative to overlayed carrier surface without requiring the master sheet to be removed. Thus in that patent, the invention provided an improved master clamping mechanism which was relatively easy to operate, which permitted angular adjustment of the universal master clamp and which was reliable.

There are other problems concerned with duplicating mechanisms. First, when the leading edge clamping assembly is adjusted from both sides, it requires a high degree of operator skill to properly position the leading edge clamp assembly to correct the problem of skewing. In addition, once the leading edge clamp assembly has been adjusted, then the trailing edge clamp assembly must be separately adjusted to compensate for the movement of the tail end of the plate or master which has moved because of the adjustment of the leading edge clamp assembly. Also, the prior art does not make any effort to correct for varying plate thicknesses except by using the operator with a high degree of skill to adjust the proper pressure of the clamp assembly to accommodate varying sizes or thicknesses of the plates or masters.

The first problem, adjusting of both the leading and trailing edge plate clamps, has been considered in the prior art. German patents Nos. 893,343, 0,401,500, and 1,536,954 and U.S. Pat. No. 4,785,736 all disclose mechanisms for adjusting the leading edge and trailing edge plate clamps. In German patent No. 893,343, it appears that each of the leading edge and trailing edge plate clamps can be both rotated about a center pivot point and axially moved in either direction. They can also cause both the leading edge and trailing edge plate clamp assemblies to move axially in the same direction. German patent No. 0,401,500 discloses a mechanism for adjusting the leading and trailing edge clamps by rotating two separate pivot levers, one at each end of the plate clamps, that are coupled to both plate clamps. When the levers are rotated, one plate clamp moves axially in one direction and the other plate clamp moves axially in the other direction simultaneously. German patent No. 1,536,954 has a similar mechanism except that a single lever is coupled to the center of each plate clamp and is rotatably mounted to the frame at the center point of the lever. Adjusting the lever to move the leading edge plate clamp axially in one direction simultaneously moves the trailing edge plate clamp in the opposite direction. The device in U.S. Pat. No. 4,785,736 operates in a manner similar to the operation of German patent No. 0,401,500. In each of these patents, both the leading edge and trailing edge plate clamps are required to move axially, or axially and angularly, thus increasing the difficulty of the adjustment and the complexity of the adjusting mechanism.

The present invention overcomes the disadvantages of the prior art by providing a leading edge plate holding or clamp assembly which is formed with either a cantilevered or pivoted beam which has first and second register pins thereon and a calibrated adjustment fixture that adjusts the leading edge plate causing one of the register pins to move with respect to the other and enabling skewing of the leading edge of the master or plate.

In addition, a linkage exists between the leading edge clamp assembly and the trailing edge clap assembly such that adjusting the leading edge plate clamp assembly to skew the leading edge of the plate automatically adjusts the trailing edge clamp assembly in proper alignment with the trailing edge of the skewed master or plate.

Finally, spring means are interposed between the plate cylinder and each of the clamps for automatically compensating for variation in the thickness of the plate being clamped simply by the operator moving a control lever from a first position to a second position. Thus, no individual operator adjustment is required. The operator simply opens the clamp or closes it and it automatically adjusts to compensate for plates or masters of variable thickness.

Thus, it is one aspect of the present invention to provide a clamping or holding assembly for a duplicating machine such as a printing press or the like which utilizes a cantilever or pivoted beam that is adjusted to enable skewing of the plate as desired.

It is another aspect of the present invention to provide a coordination of the leading and trailing edge plate clamp assemblies such that adjustment of the leading edge plate clamp assembly for skew automatically adjusts the trailing edge plate clamp assembly accordingly.

It is still another aspect of the present invention to provide a plate clamp assembly for a duplicating machine such as a printing press or the like which is self-adjusting for different plate thicknesses.

It is yet another aspect of the present invention to provide a tensioning means for the trailing edge of the plate such that the plate is held uniformly tight against the cylinder in its skewed orientation.

SUMMARY OF THE INVENTION

Thus, the present invention relates to a duplicating machine having a plate cylinder rotatably mounted on a frame with plate holding assemblies having clamps or pins to hold the leading and trailing edges of a plate therein. As used herein, the term "duplicating machine" refers to a variety of devices including duplicators, copiers, printing presses such as offset or letter presses and the like.

The improved plate clamping system comprises means for adjusting the leading edge plate holding assembly to enable skewing of the plate as desired and means coupling the leading edge plate holding assembly to the trailing edge plate holding assembly such that adjusting the leading edge plate holding assembly to skew the plate automatically adjusts the trailing edge holding assembly in proper alignment with the trailing edge of the skewed plate. Spring means may be interposed between the plate cylinder and each of the holding assemblies for automatically compensating for variations in the thickness of the plate being held.

The invention also relates to an improved plate skewing apparatus in a duplicating machine having a plate cylinder frame with leading and trailing edge plate holding assemblies thereon, the improvement comprising means for attaching the leading edge plate holding assembly at one end to the plate cylinder frame in a cantilevered or pivoted fashion, and means for adjusting the leading edge plate holding assembly in a direction to enable skewing of the plate as required.

The invention further relates to an improved plate holding system in a duplicating machine having a plate cylinder frame with leading and trailing edge plate holding assemblies, the improved system comprising means for adjusting the leading edge plate holding assembly to enable skew of the plate as desired, and means coupling the leading edge plate holding assembly to the trailing edge plate holding assembly such that an adjustment of the leading edge plate holding assembly for skew automatically adjusts the trailing edge plate holding assembly a sufficient amount to cause it to be properly aligned with the trailing edge of the plate.

The invention also relates to an improved plate clamp in a duplicating machine having a plate cylinder frame with leading and trailing edge plate holding assemblies thereon, the improvement comprising an elongated beam coupled to the plate cylinder frame, an elongated clamping element associated with the beam for selective engagement with the beam to clamp or release the leading or trailing edge of a plate therein, and spring means interposed between the beam and the clamp element for automatically compensating for variations in the thickness of the plate being clamped.

BRIEF DESCRIPTION OF THE DRAWINGS

These and other objects of the present invention will be more fully understood in conjunction with the accompanying drawings in which like numbers indicate like components and in which.

DETAILED DESCRIPTION OF THE DRAWINGS

Figure 1:
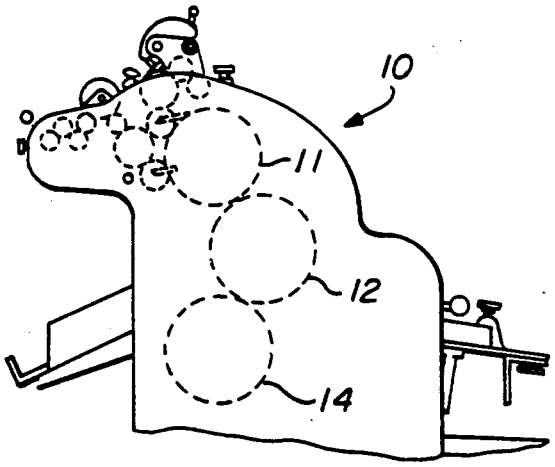
FIG. 1 is a partial side view of a typical duplicating machine illustrating the plate cylinder, the blanket cylinder and the impression cylinder.
Figure 2:
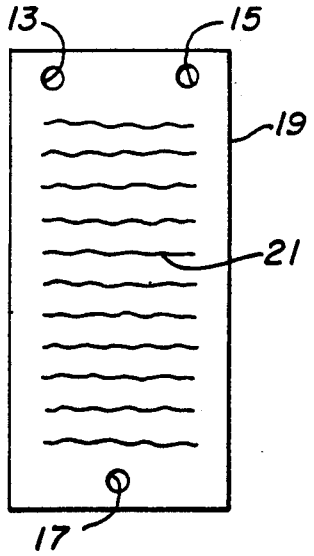
FIG. 2 is a schematic representation of a master or plate having indicia thereon and having orifices therein on the leading and trailing edges for attachment of the plate or master to the plate cylinder.
Figure 3:
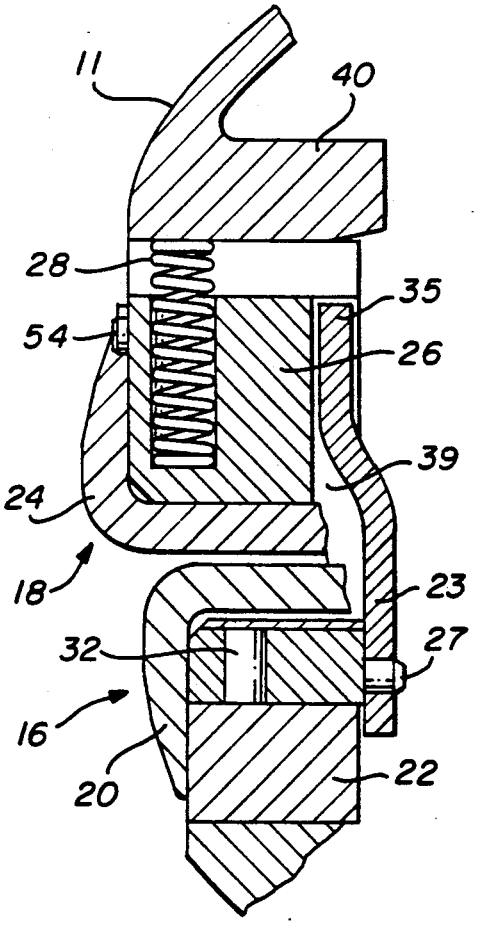
FIG. 3 is a partial cross-sectional view of the preferred embodiment of a plate cylinder illustrating the leading edge and trailing edge plate clamp or holding assemblies and the adjustment mechanism for automatically adjusting the trailing edge assembly whenever the leading edge assembly is adjusted for skew.
Figure 6:
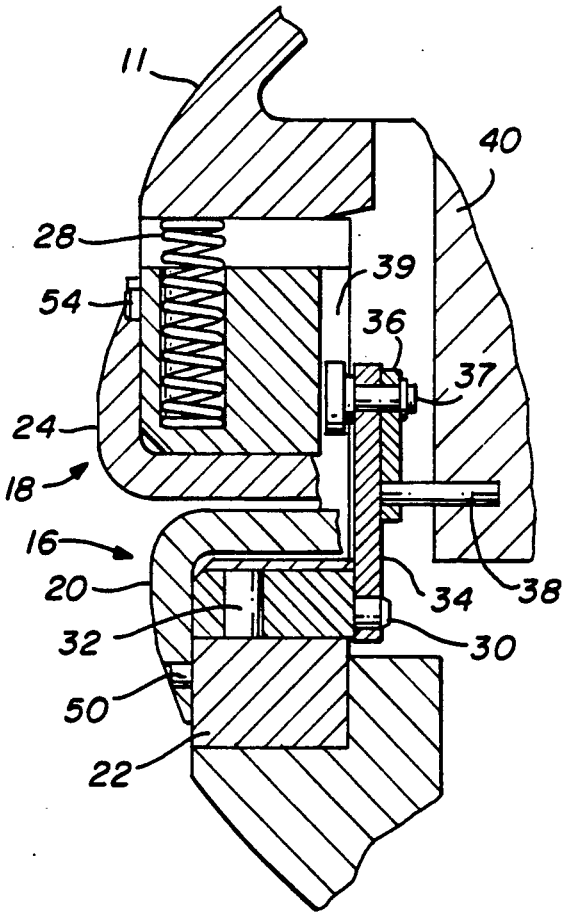
FIG. 6 is a partial cross-sectional view of a plate cylinder illustrating an alternate embodiment of the leading edge and trailing edge plate clamp or holding assemblies and the adjustment mechanism for automatically adjusting the trailing edge assembly whenever the leading edge assembly is adjusted for skew.

FIG. 1 is a partial side view of a conventional duplicating machine 10 having a plate cylinder 11, a blanket cylinder 12, and an impression cylinder 14. A master or plate such as plate 19 illustrated in FIG. 2 having indicia 21 thereon is placed on plate cylinder 11. Blanket cylinder 12 is periodically brought into contact first with plate cylinder 11 to transfer the image from the master 19 to the blanket cylinder 12 and then is brought into contact with the impression cylinder 14 to transfer the image to the copy paper passing under impression cylinder 14. As illustrated in FIG. 2, the master 19 has three holes 13, 15 and 17 which must be attached to register pins on the leading edge and trailing edge clamp assemblies. It is easily understood that the pin holes precisely locate the image with respect to the register pins on the plate cylinder 11. The pin registers on the plate cylinder 11 have to be properly positioned axially and angularly with respect to the direction of movement of the plate cylinder 11 and the plate cylinder 11 has to be registered to the blanket cylinder 12 and through the impression cylinder 14 in order for a correct image to be transferred to the paper copy passing under the impression cylinder 14. Since all of these elements cannot be precisely arranged with respect to each other in every instance because of the imprecise manner in which the master or plate is made, there must of necessity be a way to correct the skewing on the final copy paper so that the printing is aligned properly with the copy paper. FIG. 3 is a partial cross-sectional view of the preferred embodiment of the leading edge and trailing edge plate clamp or holding assemblies of the present invention illustrating the preferred manner in which skewing adjustments for the leading edge assembly and the trailing edge assembly are accomplished simultaneously. In FIG. 6, the plate cylinder 11 has a leading edge plate clamp or holding assembly 16 and a trailing edge plate clamp or holding assembly 18. The leading edge plate clamp assembly 16 has a beam element 22 and a C-shaped clamp 20. The clamp may be more clearly seen in FIGS. 9B, 9C and 10B. The trailing edge plate clamp assembly 18 includes a beam element 26 and C-shaped clamp assembly 24. A spring member 28 biases the trailing edge plate clamp assembly 18 away from the plate cylinder frame 40 to provide tension to the master or plate 19 (shown in FIG. 2) attached thereto and hold the plate 19 uniformly tight against the cylinder in its skewed orientation. The leading edge plate clamp assembly 16 has register pins 50 and 52 (more clearly shown in FIG. 4) while the trailing edge plate clamp assembly 18 includes a single register pin 54. These are the register pins to which the plate 19 in FIG. 2 is attached with the pin holes 13, 15 and 17. The leading edge plate clamp assembly 16 and the trailing edge plate clamp assembly 18 are shown in FIG. 6 in their closed positions. It will be noted that an eccentric pivot pin 30 in the beam 22 of the leading edge plate clamp assembly 16 is attached to bell crank link 23 at one end thereof. The other end 35 of link 23 rides in a slot 39 in the beam element 26 in the trailing edge plate clamp assembly 18. This can be seen more clearly from the top view in FIG. 4. One end 25 of the bell crank link 23 is pivotally coupled at 27 to the beam 22 in the leading edge plate clamp assembly 16. The bell crank arm 29 is positioned in a slot 31 in the plate cylinder frame 40. Whenever the leading edge plate clamp assembly 16 is moved in FIG. 3 or FIG. 4 toward the trailing edge plate clamp assembly 18, the movement of the bell crank linkage about end 25 causes a pivotal movement by arm 29 in slot 31 to cause the far end 35 of the bell crank link 23 to move in the direction of arrow 33, thus causing a force to be applied to the beam 26 to move it in a direction to automatically adjust the trailing edge plate clamp assembly and cause it to be in proper alignment with the trailing edge of the skewed front end of the master or plate. It will be noted in FIG. 3 that the pivot 30 is an eccentric pivot, which, when rotated, can adjust the initial relationship of the leading edge plate clamp assembly 16 to the trailing edge plate clamp assembly 18. Once it is adjusted, a locking set screw or other locking device may be used to prevent further rotation of the eccentric pivot 30. Thereafter, any skewing adjustment of the leading edge plate clamp assembly 16 automatically adjusts the trailing edge plate clamp assembly 18 axially to compensate for the skewed front end of the master or plate.

Figure 4:
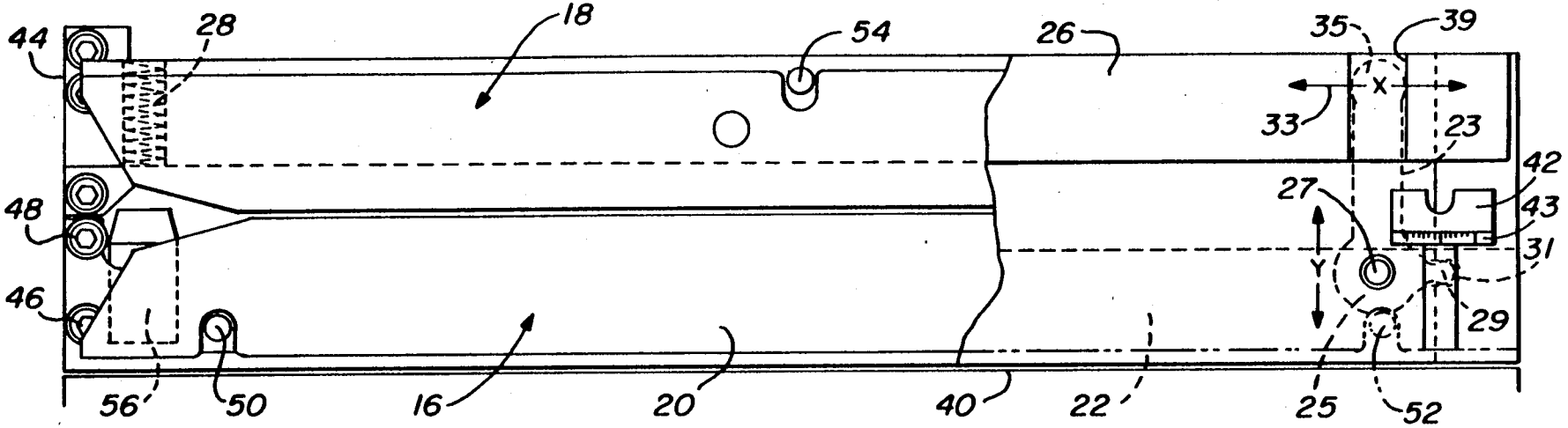
FIG. 4 is a top view of the leading edge and trailing edge clamp assemblies of the preferred embodiment illustrating the register pins, the skew adjustment mechanism and the bell crank linkage connecting the leading edge assembly and the trailing edge assembly for causing an automatic adjustment of the trailing edge assembly when the leading edge assembly is adjusted.

FIG. 4 is an illustrative top view of the preferred embodiment of the leading edge plate clamp assembly 16 and the trailing edge plate clamp assembly 18. It will be seen in FIG. 4 that the beam 22 in the leading edge clamp assembly 16 is attached by bolts 46 and 48 to the plate cylinder at one end thereof. It also has a fixed register pin 50 and a register pin 52 that moves with the outer end of beam 22. Thus, a skewing adjustment screw 42 is threadedly inserted in the beam 22 and contacts the plate cylinder frame 40. By rotating the skewing adjustment screw 42, the beam 22 can pivot about bolt 46 in a direction horizontally toward the trailing clamp assembly 18 and tangentially to the plate cylinder 11 causing outer pin 52 to move from its position shown in FIG. 4. Thus, since the register pin 50 is essentially fixed in its position near the end of the beam 22 that is pivotally attached to the plate cylinder frame 40, movement of the beam 22 by the skewing screw 42 angularly adjusts the skew of the plate or master attached to the register pins 50 and 52. Trailing plate clamp 18 has one register pin 54 for receiving the orifice 17 in the trailing edge of the master 19 shown in FIG. 2. As the skewing adjustment screw 42 is rotated to move the beam 22 towards the trailing edge plate clamp assembly 18, bell crank link 23 is pivoted about point 27 by arm 29 in slot 31. Because slot 31 is fixed in the plate cylinder frame 40, movement of the bell crank link 23 in a clockwise applies an axial force in the direction to the right in FIG. 4, thus moving the trailing edge clamp assembly 18 to the right. The trailing clamp register pin 54 is thus moved to automatically adjust to the proper alignment with the trailing edge of the skewed plate 19.

Calibration scale 43 may be coupled to the skew adjusting screw 42 to give the operator an indication of how much skew is being accomplished by calibrated rotation of screw 42. A slide clamp 44 shown from the top on the left side of FIG. 4 and a similar clamp on the right side of clamp assembly 18 (not shown) holds clamp assembly 18 for sliding axial movement. One of the slide clamps 44 is shown more clearly on the right end of clamp assembly 16 in FIG. 5. The slide clamps 44 have a small vertical clearance 41 with the base of the clamp assembly 16 or 18 of about 0.002 or 0.004 inches. They have a horizontal clearance 45 with the base of the clamp assemblies 16 or 18 of approximately 0.093 to 0.100 inches for slidable adjustment of the clamp assemblies 16 and 18.

Figure 5:
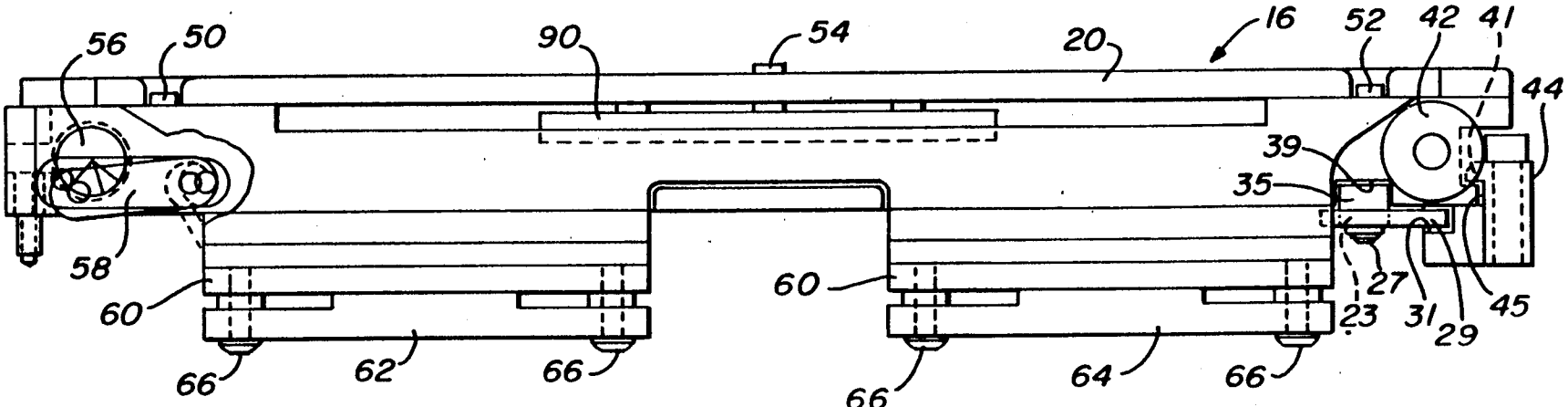
FIG. 5 is a front view of one of the clamp assemblies illustrating the preferred embodiment of the skew adjustment mechanism and the bell crank linkage coupling the leading edge and trailing edge clamp assemblies.

FIG. 5 is a front view of the leading edge plate clamp assembly 16 illustrated in FIG. 4. An end view of the bell link 23 is shown illustrating the bell crank arm pivotally held in slot 31 and with the end portion 35 in slot 39. Also shown in FIG.. 5 is a portion of the spring mechanism for compensating for the variable thickness of plates or masters that may be used. It will be noted that first and second elongated bars 62 and 64 are coupled by any well-known means 66, such as screws, to the bottom edge 60 of the C-shaped clamp 20 of leading edge clamp assembly 16. Slide clamps 44, as stated earlier, have the proper clearance with clamp assemblies 16 and 18 to allow lateral adjustment of the leading edge plate clamp assembly 16 during installation and for leading and trailing edge clamp movement during adjustment of the plate 19 with respect to the cylinder 11. A rotatable actuator 56 is coupled to a connecting link 58 that is also pivotally coupled to the spring bar 68 as shown more clearly in FIGS. 9A and 10A.

FIG. 6 is a partial cross-sectional view of an alternate embodiment of the leading edge and trailing edge plate clamp or holding assemblies of the present invention illustrating another manner in which skewing adjustments for the leading edge assembly and the trailing edge assembly may be accomplished simultaneously.

In FIG. 6, the plate cylinder 11 has a leading edge plate clamp or holding assembly 16 and a trailing edge plate clamp or holding assembly 18 similar to that shown in FIG. 3. The construction of the assembly shown in FIG. 6 is similar to that shown in FIG. 3 except for the means for automatically adjusting the trailing edge assembly as the leading edge is adjusted for skew. It will be noted that an eccentric pivot pin 30 in the beam 22 of the leading edge plate clamp assembly 16 has a link 34 attached to it at one end thereof. The other end of link 34 is attached to a squareheaded pivot pin 37 which rides in a slot 39. Again, this can be more clearly seen from a top view in FIG. 7. A second link 36 is pivotally connected to the squareheaded pivot pin 37 and to a pin 38 attached to the plate cylinder frame 40. Whenever the leading edge plate clamp assembly 16 is moved in FIG. 6 toward the trailing edge plate clamp assembly 18, the movement of linkage 34 with respect to linkage 36 causes a force to be applied to the beam 26 to move it in a direction automatically adjusting the trailing edge plate clamp assembly to cause it to be in proper alignment with the trailing edge of the skewed front end of the master or plate. It will be noted that the pivot 30 is an eccentric device which, when rotated, can adjust the initial relationship of the leading edge plate clamp assembly 16 to the trailing edge plate clamp assembly 18. Once it is adjusted, a locking set screw 32 is fixed to prevent further rotation of the eccentric pivot 30. Thereafter, any skewing adjustment of the leading edge plate clamp assembly 16 automatically adjusts the trailing edge plate clamp assembly 18 axially to compensate for the skewed front end of the master or plate.

Figure 7:
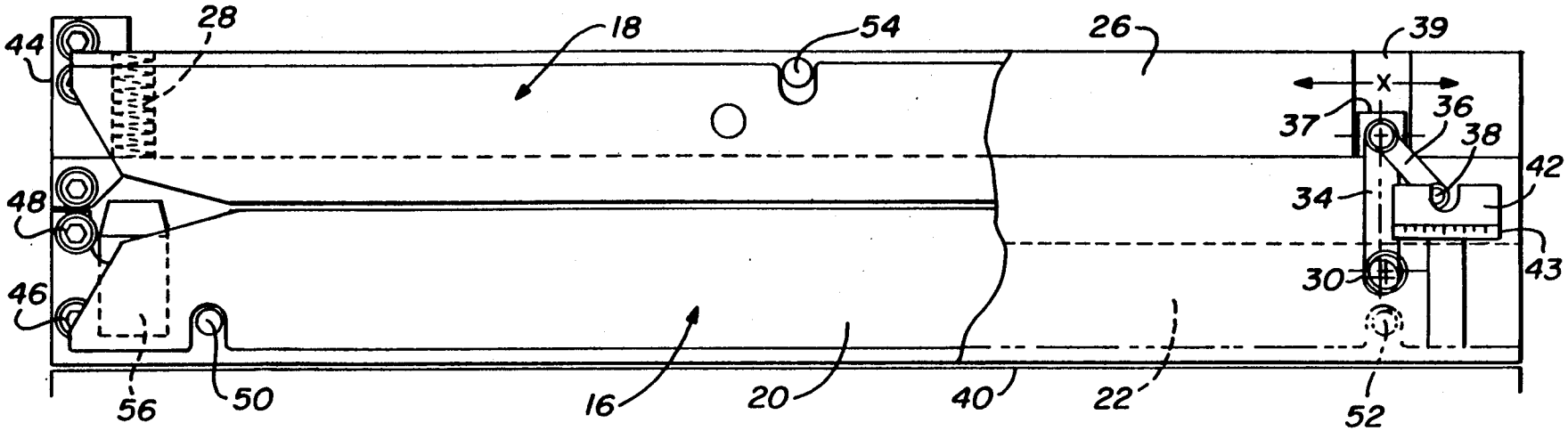
FIG. 7 is a top view of the leading edge and trailing edge clamp assemblies of the alternate embodiment illustrating the register pins, the skew adjustment mechanism and the linkage connecting the leading edge assembly and the trailing edge assembly for causing an automatic adjustment of the trailing edge assembly when the leading edge assembly is adjusted.

FIG. 7 is an illustrative top view of the alternate embodiment of the leading edge plate clamp assembly 16 and the trailing edge plate clamp assembly 18. It will be seen in FIG. 7 that the beam 22 in the leading edge clamp assembly 16 is attached by bolts 46 and 48 to the plate cylinder 40 at one end thereof. It also has a fixed register pin 50 and a register pin 52 that moves with the outer end of the beam 22. Thus, a skewing adjustment screw 42 is threadedly inserted in the beam 22 and contacts the plate cylinder frame 40. By rotating the skewing adjusting screw 42, the beam 22 can be flexed as a cantilevered beam or, preferably, pivoted about bolt 46 in a direction horizontally toward the trailing clamp assembly 18 and tangential to the plate cylinder 11 causing outer pin 52 to move from its position shown in FIG. 7. Thus, since the register pin 50 is essentially fixed because of its position near the end of the beam 22 that is attached to the plate cylinder frame 40, movement of the beam by the skewing screw 42 angularly adjusts the skew of the plate or master attached to the register pins 50 and 52. Trailing plate clamp 18 has one register pin 54 for receiving the orifice 17 in the trailing edge of the master 19 shown in FIG. 2. As the skewing adjustment screw 42 is rotated to above the outer end of beam 22 towards the trailing edge plate clamp assembly 18, link 34, which is attached to squarehead pivot pin 37, moves pin 37 in a straight line because it is in slot 39. Because pin 38 is rigidly attached to the plate cylinder frame 40 , movement of the second link 36 in a clockwise direction applies an axial force in the direction to the right in FIG. 7, thus moving the trailing edge clamp assembly 18 to the right in FIG. 7. The trailing clamp register pin 54 is thus moved to automatically adjust to the proper alignment with the trailing edge of the skewed plate 19. Again, a calibration scale 43 may be coupled to the skew adjusting screw 42 to give the operator an indication of how much skew is being accomplished by calibrated rotation of screw 42.

Figure 8:
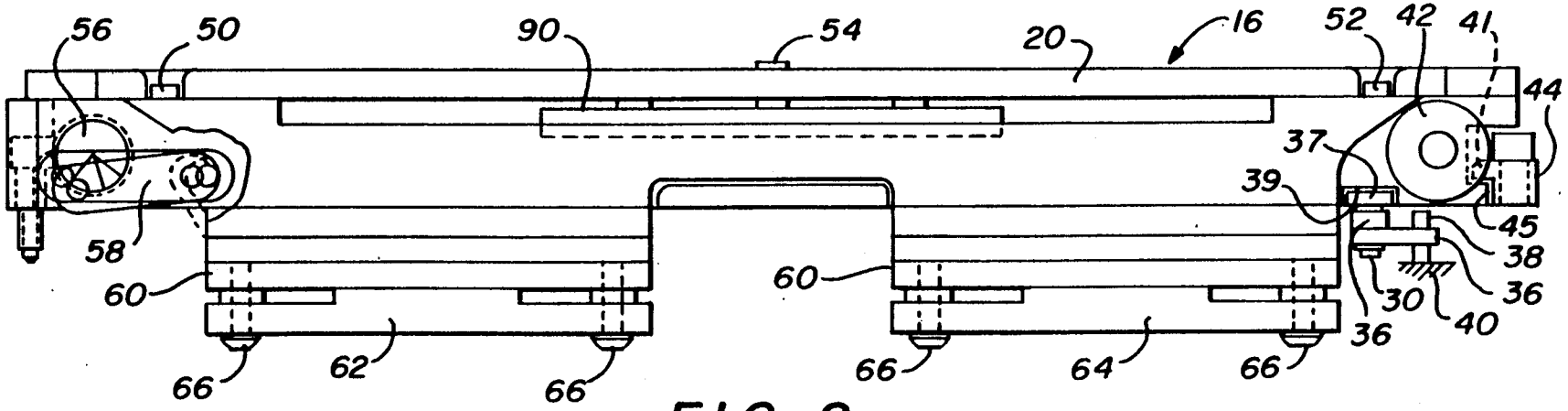
FIG. 8 is a front view of one of the clamp assemblies of the alternate embodiment illustrating the skew adjustment mechanism and the linkage coupling the leading edge and trailing edge clamp assemblies.

FIG. 8 is a front view of the leading edge plate clamp assembly 16 illustrated in FIG. 7. The linkage 34 and 36 is shown as well as the squareheaded pin 37 in slot 39 of beam 26 in the trailing edge assembly 18 for adjusting the trailing edge plate clamp assembly 16 automatically with an adjustment of the leading edge plate clamp assembly 16 for skew. Also shown in FIG. 8 is a portion of the spring mechanism for compensating for the variable thickness of plates or masters that may be used. It will be noted that first and second elongated bars 62 and 64 are coupled to the bottom edge 60 of the C-shaped clamp 20 of leading edge clamp assembly 16 in the manner as shown in FIG. 5. Slide clamp 44 allows lateral adjustment of the leading edge plate clamp assembly 16 during installation. The rotatable actuator 56 is shown coupled the connecting link 58 that is also pivotally coupled to the spring bar 68 as shown in FIGS. 9A and 10A.

Figure 9A:
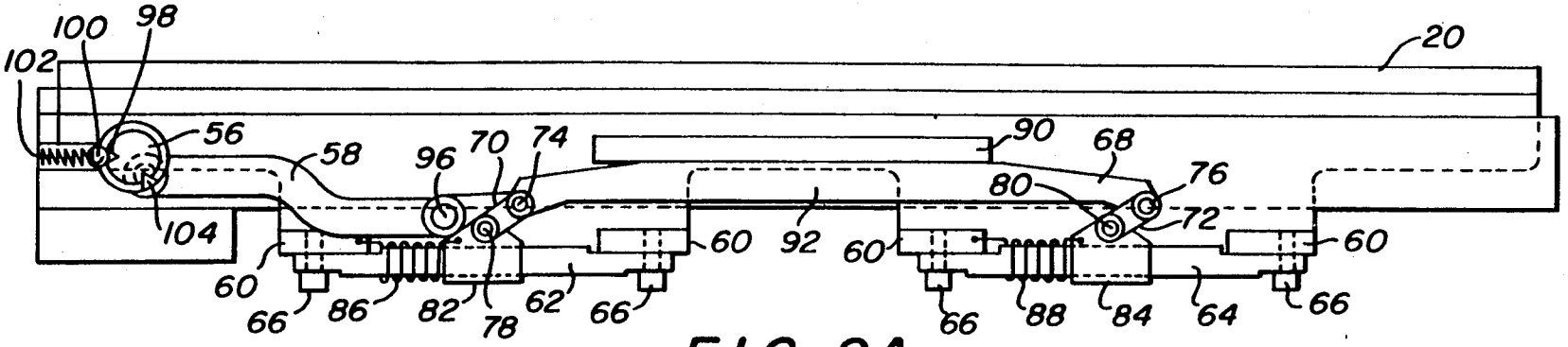
FIG. 9A is a schematic representation of a front view of one of the clamp assemblies illustrating the spring mechanism which automatically compensates for plate thickness.
Figure 10A:
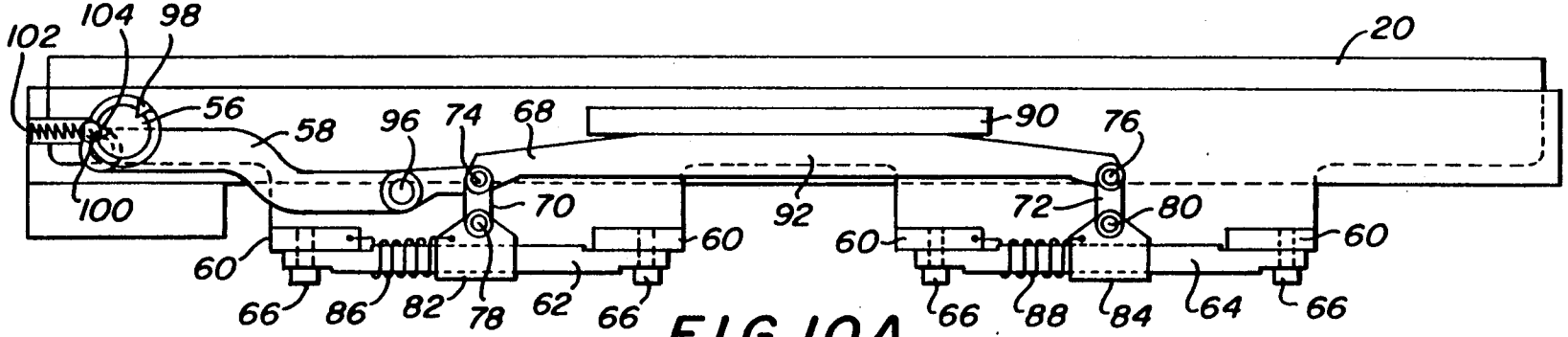
FIG. 10A is a schematic representation of a front view of one of the clamp assemblies in its closed position.

As can be seen in FIG. 9A, the cantilevered beam 22 has an elongated clamp element 20 associated with beam 22 for selective engagement with the beam 22 to clamp or release the leading edge of a plate therein. Spring bar 68, linkages 70 and 72 and carriage assemblies 82 and 84 are interposed between the beam 22 and the clamp element 20 for automatically compensating for variations in the thickness of the plate being clamped. The elongated spring bar 68 is slidably associated in the center portion 92 thereof with the beam 22 through a wear strip 90.

The wear strip 90 is constructed from an anti-friction material such as an oil impregnated sintered bronze, a suitable plastic and the like for providing a means of making a "factory adjustment" to accommodate for the manufacturing tolerances of components. The actuator 56 is coupled through connecting link 58 to one end 96 of spring bar 68 for moving the spring bar 68 axially to cause toggle links 70 and 72 to move the elongated clamp 20 into engagement with the beam 22 to clamp the edge of the plate therein. It will be noted that the spring bar 68 is thicker in the center portion 92 and tapered toward each end 74 and 76 such that the spring bar 68 can flex at each end to accommodate variations in the thickness of the plate being clamped.

The wear strip 90 positioned between the center portion 92 of the elongated spring bar 68 and the beam 22 prevents wear of the beam 22 during sliding motion of the spring bar 68. First and second spaced elongated bars 62 and 64 are each attached at each end axially to the plate clamp bottom edge 60 for distributing a force applied to the first and second and space bars 62 and 64 equally to the plate clamp 20 at each end of each space bar.

Carriage elements 82 and 84 are mounted on a respective one of the first and second space bars 62 and 64 with each carriage element pivotally coupled to a respective toggle link at 78 and 80, respectively, on the ends of the spring bar 68 for receiving a force from the toggle links 70 and 72 when the spring bar 68 is moved axially. Thus, the spaced bars 62 and 64 distribute the received force to the plate clamp 20 equally at each end of each space bar 61 and 64.

Figure 9C:
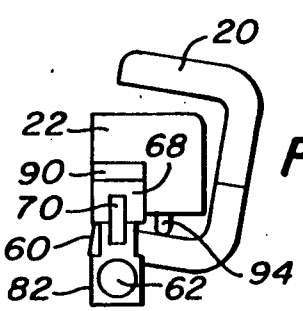
FIG. 9C is an end view of the clamp assembly in FIG. 9A illustrating the clamp in its open position ready to close.
Figure 9B:
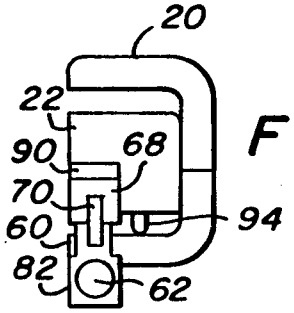
FIG. 9B is an end view of the clamp assembly in FIG. 9A illustrating the clamp in its wide open position.

It will be noted in FIG. 9A that the rotatable actuator 56 has a first detent 98 therein which receives a ball 100 urged therein by spring 102. Thus, the rotatable actuator will lock and be held in its selected position and will not move because of incidental forces such as vibration. The position of the clamp 20 with relation to beam 22 is illustrated in its open position in FIG. 9B and is shown movably associated with beam 22 through a pivot point 94. FIG. 9C illustrates the relationship of the clamp 20 to the beam 22 when it has been moved forward but not clamped over the leading edge of the plate or master.

Figure 10B:
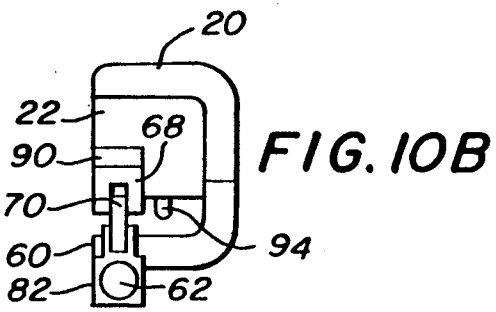
FIG. 10B is an end view of the clamp assembly in FIG. 10A illustrating the closed relationship of the clamp to the beam.

FIG. 10A illustrates the leading edge plate clamp assembly 16 in its closed position. The end view of FIG. 10B shows the toggle link 70 having been moved to the vertical position by the sliding motion of spring bar 68. As stated, rotatable actuator 56 has a connecting link 58 pivotally coupling the rotatable actuator 56 and the one end 96 of the spring bar such that rotation of the rotatable actuator 56 moves the spring bar 68 axially to cause the clamp 20 to move into engagement with the beam 22. First and second spaced detents 98 and 104 in the rotatable actuator 56 represent open and clamped positions of the plate clamp assembly 16. Ball 100 sequentially engages the first and second detents 98 and 104 as the actuator 56 is rotated and spring 102 in the plate cylinder housing 40 forces the ball 100 into the first and second detents 98 and 104 in the open and clamped positions of the actuator 56 to prevent unwanted rotary motion of the actuator 56 due to incidental forces such as vibration. Spring members 86 and 88 may be interposed between the carriage assemblies 82 and 84 and their respective attachment to the underside 60 of the C-shaped plate clamp 20 for the purpose of biasing the plate clamp 20 into position as illustrated in FIG. 9C.

In summary, the novel plate clamp assembly of the present invention provides a novel apparatus for adjusting the leading edge plate clamp assembly to enable skewing of the plate as desired, couples the leading edge plate clamp assembly to the trailing edge plate clamp assembly such that adjusting the leading edge plate clamp assembly to skew the plate automatically adjusts the trailing edge plate clamp assembly in proper alignment with the trailing edge of the skewed plate and it provides spring means interposed between the plate cylinder and each of the clamps for automatically compensating for variations in the thickness of the plate being clamped.

The preferred embodiment of the improved apparatus for adjusting the leading edge plate clamp assembly to enable skewing of the plate uses a beam pivotally attached to the plate cylinder frame at one end. A plate clamp is associated with the beam to form the leading edge plate clamping assembly and the plate clamp is operatively associated with the beam to clamp or release the leading edge of the plate inserted therein. A calibrated screw or other adjusting means is coupled to the other end of the pivoted beam for moving the outer end of the beam in a direction tangential to the plate cylinder to enable skewing of the plate as desired. In an alternative embodiment, a cantilevered beam, rigidly attached to the frame at one end, may be flexed by adjusting the calibrating screw to cause the necessary adjustment for skew.

Means are provided for coupling the leading edge plate clamp assembly to the trailing edge plate clamp assembly such that adjusting the leading edge plate clamp assembly to skew the plate automatically adjusts the trailing edge clamp assembly in proper alignment with the trailing edge of the skewed plate. A plate clamp is associated with a noncantilevered beam to form the trailing edge plate clamp assembly. A linkage system couples the leading edge plate clamp assembly to the beam of the trailing edge plate clamp such that pivoting or flexing of the leading edge plate clamp assembly beam towards the trailing edge plate clamp assembly to skew the plate moves the trailing edge beam axially to adjust the trailing edge plate clamp assembly a corresponding amount and to properly align it with the trailing edge of the skewed plate.

Finally, the spring means interposed between the plate cylinder at each of the clamps for automatically compensating for variations in the thickness of the plate being clamped utilizes an elongated spring bar that is thicker in the center portion and tapered toward each end such that the spring bar can flex at each end to accommodate variations in the thickness of the plate being clamped. Further, it utilizes a rotatable actuator coupled to the spring bar with a connecting link. The actuator has first and second spaced detents representing open and clamped positions of the plate clamp. Thus the operator simply rotates the actuator from one detent to the other to clamp and unclamp the plate clamp assembly over a plate. The spring bar and its associate complements then automatically adjusts for any variations in thickness of the plate and provide a downward force that is distributed equally to the four locations where the first and second spaced elongated bars are attached to the underside of the C-shaped plate clamp.

Thus, with the present invention only the outer one of the stainless steel register pins in the cantilever beam of the leading edge plate clamp assembly moves simultaneously when the beam is flexed to adjust the angular position of the plate leading edge.

Thus, there has been disclosed a novel plate clamp assembly in which the clamping action is caused a single rotation of the actuator from a first position locking or clamping the plate clamp assembly and a second position unlocking or releasing the plate clamp assembly. The amount of movement of the clamp tool is independent of the thickness of the plate and is therefore not subject to operator judgment. Incorporated into the plate clamp are spring bar elements which flex to compensate for the differences in plate thickness. The clamping, of course, is proportional to the thickness of the plate. A heavy plate has greater clamping forces applied to it. A toggle action is incorporated into the design to reduce operator effort. The clamping force is automatically equalized across the width of the clamping surface.

Pin registers are incorporated into the design. Two precision stainless steel pins are located in the leading edge plate clamp to engage orifices in the plate which precisely locates the image on the plate cylinder thus reduces waste and make-ready time. Should skewing be required, precision register adjustment skews only one of the pins slightly. This is accomplished by pivoting or flexing the lead edge beam, thus eliminating any clearance or backlash in the system. In addition, the movement of the lead clamp assembly automatically causes a corresponding sideways motion of the trail edge clamp. Thus, when the plate is wrapped around the cylinder, the slot in the trailing edge of the plate will align with a pin in the center of the trailing edge plate clamp causing the plate to properly conform to the surface of the cylinder and eliminate wrinkling and misregistering. Other plate clamps use means for skewing which require operator skill and give no indication as to the proper position of the trailing edge of the plate.

As best illustrated in FIGS. 4–5, the trailing clamp may be loosened to accommodate removal of the master from the plate cylinder by rotating an eccentric pin 106 which causes an eccentric projection 108 engaging the cylinder body 40 to exert a side force on the trailing clamp assembly 18 which compresses the springs 28 and loosens the plate. The toggle goes over center so that it will stay in the loosened state.

The trailing clamp can be pivoted open to facilitate inserting or removing the trailing edge of the plate under the clamp. When the operator inserts a clamp tool into the actuator and pulls it toward him, it automatically tips the clamp forward over the plate and then pulls it down clamping the plate. If the desire is to skew the plate, a calibrated adjusting screw which reads out in 0.001 inch increments is adjusted as desired by the operator. While this adjustment is being done, the trailing edge clamp automatically moves to compensate for the movement of the leading edge. Thus, when the trailing edge is retensioned, the plate is held tightly over the entire circumference of the cylinder. A pair of springs in the trailing edge clamp take up any slack which may develop as the trailing edge of the plate is rolled back during the action of the printing.

Thus, there has been disclosed a novel plate clamp assembly for a duplicating machine which has two detent positions for ease of operation. The operator simply opens or closes the clamps without regard to plate thickness. The plate is capable of gripping different thicknesses of plates or masters effectively and automatically. It accommodates pin register masters and permits easy alignment of the plate after the plate has been mounted on the plate cylinder by automatically adjusting the trailing edge clamp assembly when the leading edge clamp assembly is adjusted.

The foregoing specification describes only the embodiments of the invention shown and/or described. Other embodiments may be articulated as well. The terms and expressions used, therefore, serve only to describe the invention by example and not to limit the invention. It is expected that others will perceive differences which, while different from the foregoing, do not depart from the scope of the invention herein described and claimed. In particular, any of the specific constructional elements described may be replaced by any other known element having equivalent function.

What is claimed is:

1. In a duplicating machine having a plate cylinder rotatably mounted on a frame with plate clamp assemblies having clamps to hold the leading and trailing edges of a plate therein, an improved plate clamping system comprising:

means for attaching the leading edge plate clamping assembly only at one end to the plate cylinder such that the leading edge plate clamping assembly has no axial movement; means for adjusting only the other end of the leading edge plate clamping assembly in a direction laterally with respect to its longitudinal axis to enable skewing of the leading edge plate as required; and means coupling the leading edge plate clamp assembly to the trailing edge plate clamp assembly such that laterally adjusting only the other end of the leading edge plate clamp assembly to skew the leading edge plate automatically moves the trailing edge clamp assembly only axially to cause it to be in proper alignment with the trailing edge of the skewed plate.

2. The duplicating machine of claim 1 further including spring means interposed between the plate cylinder and each of the clamps for automatically compensating for variations in the thickness of the plate being clamped.

3. The duplicating machine of claim 1 wherein said leading edge plate clamping assembly is rigidly attached at said one end to the plate cylinder in a cantilevered manner.

4. The duplicating machine of claim 1 wherein said leading edge plate clamping assembly is pivotally attached at said one end to the plate cylinder.

5. The duplicating machine of claim 1 wherein said leading edge clamping assembly is adjusted at the other end in an essentially tangential direction relative to the plate cylinder in order to enable skewing of said plate.

6. In a duplicating machine having a plate cylinder frame with leading and trailing edge plate holding assemblies thereon, improved plate skewing apparatus comprising:

means for attaching only one end of the leading edge plate holding assembly to the plate cylinder frame in a cantilevered fashion; and a bell crank for coupling the other end of the leading edge plate holding assembly to the trailing edge plate holding assembly such that by adjusting only the other end of the leading edge assembly about said attaching means to skew the leading edge of the plate, the trailing edge assembly is automatically adjusted only axially by the bell crank to properly receive the plate trailing edge.

7. The duplicating machine of claim 6 wherein said leading and trailing edge plate holding assemblies comprise either clamps or pin arrangements.

8. The duplicating machine of claim 7 wherein said leading edge plate holding assembly is rigidly attached at said one end to the plate cylinder.

9. The duplicating machine of claim 7 wherein said leading edge plate holding assembly is pivotally attached at said one end to the plate cylinder.

10. The duplicating machine of claim 6 wherein the leading edge plate holding assembly further comprises:

a beam pivotally attached to the plate cylinder frame at only one end;

a plate clamp associated with the beam to form the leading edge plate clamping assembly and for selective engagement with the beam to clamp or release the leading edge of a plate therein; and means coupled to the other end of the beam for adjusting only the other end of the beam laterally and in a direction tangential to the plate cylinder to enable skewing of the leading edge of the plate as desired.

11. The duplicating machine of claim wherein the means for adjusting the beam comprises:

a calibrated adjustment screw mounted in the other end of the beam with its distal end in engagement with the plate cylinder frame such that rotation of the screw moves the other end of the beam laterally; and means on the proximal end of the adjustment screw enabling calibrated rotation thereof during the lateral movement in which only the other end of the beam is tangentially moved with respect to the plate cylinder frame to cause skewing of the plate.

12. In a duplicating machine having a plate cylinder frame with leading and trailing edge plate holding assemblies thereon, an improved plate clamping system comprising:

means for adjusting only one end of the leading edge plate holding assembly laterally to enable skewing of the leading edge plate as desired while maintaining the other end of the plate holding assembly stationary; and an adjustment link coupling the leading edge plate holding assembly to the trailing edge plate holding assembly such that an adjustment of only the one end of the leading edge plate holding assembly laterally causes the link to automatically adjust the trailing edge plate holding assembly for only axial movement an amount sufficient to cause it to be in proper alignment with the trailing edge of the skewed plate.

13. A duplicating machine as in claim 12 wherein the means for adjusting the leading edge plate holding assembly to enable skewing of the plate comprises:

a first elongated beam pivotally attached to the plate cylinder frame at only one end in a cantilevered fashion;

a plate clamp associated with the first beam to form the leading edge plate clamping assembly and for selective engagement with the first beam to clamp or release the leading edge of a plate therein; and means coupled to the other end of the beam for moving only the other end of the beam laterally in a direction tangential to the plate cylinder to enable skewing of the plate as desired.

14. The duplicating machine of claim 13 wherein the automatic trailing edge plate clamp adjusting means comprises:

a second elongated beam associated with the plate cylinder frame only for axial movement;

a second plate clamp associated with the second beam to form the trailing edge plate clamp assembly; and a second link associated with the trailing edge plate clamp and coupled to the adjustment link such that movement of only the other end of the leading edge plate clamp assembly beam laterally towards the trailing edge plate clamp assembly to skew the plate causes the adjustment link to move the trailing edge beam only axially to adjust the trailing edge plate clamp assembly a corresponding amount to properly align it with the trailing edge of the skewed plate.

15. The duplicating machine of claim 14 wherein the adjustment link coupling the leading edge plate clamp assembly to the beam of the trailing edge plate clamp assembly further comprises:

a first link pivotally coupled at a first end to the leading edge plate clamp assembly beam and pivotally and slidably coupled at a second end to the trailing edge plate clamp assembly; and said second link pivotally coupled at an angle between the second end of the first link and the plate cylinder frame such that movement of only the other end of the leading edge plate clamp assembly beam laterally towards the trailing edge plate clamp assembly causes only a corresponding axial motion of the trailing edge plate clamp assembly to properly align it with the trailing edge of the skewed plate.

16. The duplicating machine of claim 15 further comprising:

a transverse slot in the beam of the trailing edge plate clamp assembly;

a link attachment device mounted for slidable movement in the slot; and each of the first and second links having one end pivotally coupled to the slidable link attachment device such that movement of the other end of the leading edge plate clamp assembly beam causes the first link to move the link attachment device along the slot and causes the second link to apply a force axially to the elongated trailing edge beam and its associated plate clamp.

17. In a duplicating machine having a plate cylinder frame with leading and trailing edge plate clamps thereon, an improved plate clamp comprising:

an elongated beam coupled to the plate cylinder frame only at one end in a cantilevered fashion;

an elongated clamp element associated with the beam for selective engagement with the beam to clamp or release the leading or trailing edge of a plate therein; and spring means interposed between the beam and the clamp element for automatically compensating for variations in the thickness of the plate being clamped as the clamp is moved from the open to the clamped position.

18. A duplicating machine as in claim 17 wherein the spring means comprises:

an elongated spring bar slidably associated with the beam in a center portion thereof;

a toggle link pivotally coupling each end of the spring bar to the clamp to automatically equalize the clamping force across the width of the clamping element; and actuating means coupled to one end of the spring bar for moving the spring bar axially from a first position to a second position to cause the toggle links to move the clamp into engagement with the beam to clamp the edge of the plate therein.

19. A duplicating machine as in claim 18 wherein the spring bar is thicker in the center portion and tapered toward each end such that the spring bar can flex at each end to automatically accommodate variations in the thickness of the plate being clamped.

20. A duplicating machine as in claim 19 wherein the actuator means comprises:

a rotatable actuator;

a connecting link pivotally coupling the rotatable actuator and the one end of the spring bar such that rotation of the rotatable actuator moves the spring bar axially from the first position to the second position to cause the clamp to move into engagement with the beam;

first and second spaced detents in the rotatable actuator representing open and clamped positions of the plate clamp;

a ball for engaging the first and second detents; and a spring in the plate cylinder housing for forcing the ball into the first and second detents in the open and clamped positions to prevent unwanted rotary motion of the actuator due to incidental forces such as vibrations.

21. A duplicating machine as in claim 20 further comprising:

a wear strip positioned between the center portion of the elongated spring bar and the beam to prevent wear of the beam by the sliding motion of the spring bar;

first and second spaced elongated bars each attached at each end to the plate clamp for distributing a force applied to the first and second spaced bars equally to the plate clamp at each end of each spaced bar; and a carriage element slidably mounted on each of the first and second spaced bars, each carriage element pivotally coupled to a respective toggle link on he ends of the spring bar for receiving a force from the toggle link when the spring bar is moved axially to distribute the received force to the plate clamp at each end of each spaced bar.

* * * * *